United States Patent [19]

White et al.

[11] 4,066,851

[45] Jan. 3, 1978

[54] KEYBOARD SWITCH ASSEMBLY HAVING FOLDABLE PRINTED CIRCUIT BOARD, INTEGRAL SPACER AND PREFORMED DEPRESSION-TYPE ALIGNMENT FOLD

[75] Inventors: James N. White, Carlisle; Richard E. Seeger, Topsfield, both of Mass.

[73] Assignee: Chomerics, Inc., Woburn, Mass.

[21] Appl. No.: 701,508

[22] Filed: July 1, 1976

Related U.S. Application Data

[63] Continuation-in-part of Ser. No. 627,221, Oct. 30, 1975, abandoned.

[51] Int. Cl.[2] ..... H01H 9/00; H01H 13/02

[52] U.S. Cl. ..... 200/5 A; 200/86 R; 200/159 B; 200/292; 200/306; 200/340; 361/398

[58] Field of Search ..... 200/1 R, 5 R, 5 A, 16 A, 200/159 B, 292, 340, 86 R; 317/101 F; 361/398

[56] References Cited

U.S. PATENT DOCUMENTS

| | | | |
|---|---|---|---|
| 2,798,130 | 7/1957 | Cox | 200/83 |
| 2,824,183 | 2/1958 | Marasco et al. | 200/51.09 |
| 2,843,694 | 7/1958 | Bertaux | 200/86 |
| 2,911,605 | 11/1959 | Wales, Jr. | 200/366 |
| 3,233,059 | 2/1966 | Pridham, Jr. et al. | 200/83 |
| 3,283,096 | 11/1966 | Horton | 200/86 |
| 3,383,487 | 5/1968 | Wiener | 200/292 X |
| 3,745,288 | 7/1973 | Reimer | 200/292 X |
| 3,766,439 | 10/1973 | Issacson | 317/101 F |
| 3,806,685 | 4/1974 | Seeger, Jr. et al. | 200/159 B |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,909,564 | 9/1975 | Scheingold et al. | 200/5 A X |
| 3,911,234 | 10/1975 | Kotaka | 200/5 A |
| 4,028,509 | 6/1977 | Zurcher | 200/5 A |

FOREIGN PATENT DOCUMENTS

| | | | |
|---|---|---|---|
| 2,256,992 | 6/1973 | Germany | 200/159 B |
| 1,766,162 | 10/1969 | Germany | 317/101 F |

OTHER PUBLICATIONS

IBM Tech. Disc. Bull., Lester et al, "Switch", vol. 11, No. 11, Apr., 1969, p. 1569.

IBM Tech. Disc. Bull., Harris, "Fold Switch", vol. 19, No. 10, Mar., 1977, pp. 3815, 3816.

IBM Tech. Disc. Bull, R. K. Hayes et al; "Snap Action Membrane Switch Keyboard", vol. 7, No. 12, May, 1965, p. 1168.

*Primary Examiner*—James R. Scott

*Attorney, Agent, or Firm*—Sewall P. Bronstein; Donald Brown

[57] ABSTRACT

Keyboard construction using a sheet of flexible and resilient non-conductive material preferably non-conductive plastic which is preformed in a predetermined manner for supporting both contact means and contactor means and which is adapted to be folded so that the contact and contactor means are positionable in spaced apart alignment whereby upon depression electrical contact may be made between said contact means and said contactor means.

17 Claims, 35 Drawing Figures

KEYBOARD SWITCH ASSEMBLY HAVING FOLDABLE PRINTED CIRCUIT BOARD, INTEGRAL SPACER AND PREFORMED DEPRESSION-TYPE ALIGNMENT FOLD

BACKGROUND OF THE INVENTION

This application is a continuation in part of U.S. patent application Ser. No. 627,221 filed Oct. 30, 1975 now abandoned.

This invention is directed to new and improved keyboard constructions for calculators and the like and in particular is directed to a keyboard constructions in which electrical contacts and electrical contactors are supported on a single or unitary sheet of plastic formed in a configuration which provides significant manufacturing costs savings in the construction thereof as well as in the assembly thereof. In addition this invention provides a keyboard sheet construction which is constructed to fold in a manner so as to minimize the circuit resistance when at least one of the switches of the keyboard is held closed during use of the device embodying the keyboard.

The prior art is replete with inexpensive keyboards of various types and yet due to cost pressures, demand has required that even less expensive keyboard structures be built. One of the major costs involved in keyboard construction is labor as well as the number of individual parts to be made and then assembled.

With prior art keyboards it has generally been conventional practice to screen a first circuit pattern including contacts on a bottom board and screen a second circuit including contactors on a top surface and then assemble both together as shown in U.S. Pat. Nos. 3,810,771 and 3,862,383.

In the keyboards as shown in U.S. Pat. Nos. 3,810,771 and 3,862,383 it was also conventional practice to drill holes through the bottom board and then solder pins to the first circuit pattern and provide a second pin to provide an input potential to the second circuit pattern.

Thus as may be seen a great deal of labor and a large number of separate parts were required to construct such keyboards.

The present invention provides a less costly keyboard than that shown in the aforementioned patents by reducing the number of individual keyboard parts as well as the labor needed to assemble the keyboard.

BRIEF SUMMARY OF THE INVENTION

The present invention accomplishes the part and cost reduction mentioned above by forming contactor means and contact means on a single sheet of non-conductive material, e.g., plastic material such as Mylar which is then provided with alignment means to permit it to be easily folded upon itself to provide a keyboard with the contacts in alignment with the contactors. In addition, contact and contactor output and input lines are also preferably provided on the sheet so that pins are no longer needed.

In one of the preferred keyboard constructions, a single sheet of flexible non-conductive plastic is provided with a screened on first circuit pattern having contacts and a second circuit pattern having contacts and screened on input and output lines terminating at one end of the structure are coupled to the respective circuit patterns.

Thereafter, the sheet is folded about alignment means forming a portion of the sheet so that the contactor are in selective alignment with the contacts thus providing a keyboard structure sometimes referred to herein as a sandwich. In one embodiment non-conductive foldable spacer means having a plurality of holes is provided as a part of the sheet to separate the first and second patterns from each other while permitting the contactors to pass therethrough to make contact with said contacts.

In another embodiment of the disclosure the keyboard is provided with raised protrusions to provide a tactile feel to the user. Further preferred embodiments disclose the sheet when unfolded in an "L" or side foldover configuration with the tail or connector portion thereof having external connection pads thereon, said tail forming one leg of the "L" with one leg of the "L" folding over a portion of the other leg of the "L".

DETAILED DESCRIPTION OF THE INVENTION

Figure 1:
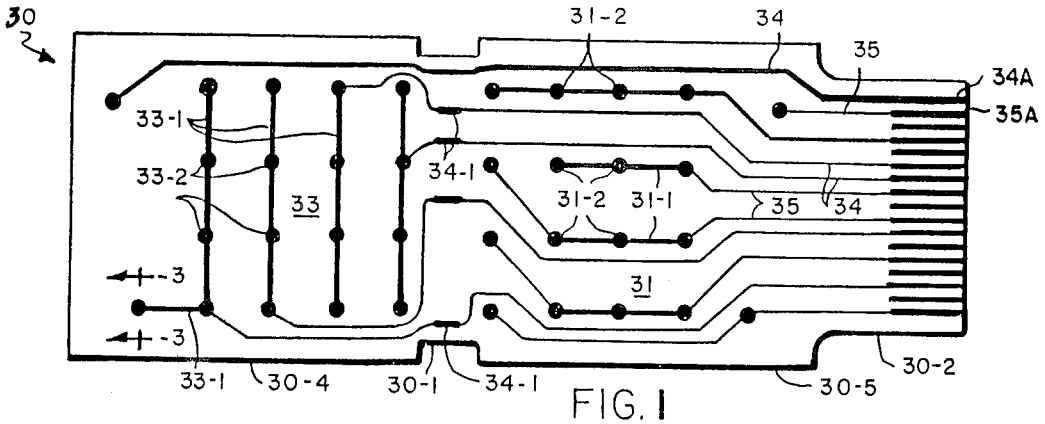
FIG. 1 is a bottom plan view of a keyboard component according to the disclosure.

Reference should now be had to FIGS. 1 to 7 for a description of the invention. At 30 there is shown a sheet of flexible and resilient plastic having a fold section 30-1, a tail section 30-2, and circuit supporting bottom and top sections 30-3 and 30-4.

The sheet 30 may be of thermoplastic or thermosetting flexible and resilient plastic materials such as polyester, polypropylene, polyethylene, silicone rubber, polyurethane, etc., with the polyester identified as Mylar being most preferred. In addition, the sheet may be a composite of steel, tin, etc., coated with plastic so that the composite is a non-conductive flexible and resilient sheet.

The bottom portion 30-3 functions as the conventional circuit board shown as 40 in U.S. Pat. No. 3,860,771, whereas the top portion functions much the same as the depressible layer 35 in the same patent except that in FIGS. 1—7 there is shown what is known as a flat style keyboard construction wherein the plastic top layer portions 30-4 is selectively depressed to make electrical contact between a contactor carried and adhered thereto and a contact supported and adhered to the bottom portion 30-3.

In particular, positioned on and adhered to bottom portion or section 30-3 is a first circuit pattern 31 comprising electrically conductive circuit lines 31-1 which are coupled to contacts 31-1. The top portion or section 30-4 supports a second electrically conductive circuit pattern 33 also positioned thereon and coupled thereto which comprises circuit lines 33-1 and contactors 33-2.

To couple the circuit patterns 31 and 33 to circuitry external the keyboard there is provided electrically conductive connection lines 34 and 35 on and adhered to the sheet 30 and which extend onto the tail portion 30-2.

The lines 34 and 35 extend on to the tail portion 30-2 where they are widened at 34A and 35A to provide terminals for coupling to other electrical devices.

In addition, lines are also preferably widened at 34-1 where they extend over the fold section 30-1 so as to ensure good conductivity when the component is folded as shown in FIGS. 4–7.

The lines 34 and 35 and the circuit patterns 31 and 33 including the respective contacts are preferably screened by electrically conductive flexible plastic comprising a flexible plastic binder and electrically conductive particles although obviously electrically conductive flexible metal strips, e.g., metal, copper or thin strips may also be used which may be formed by conventional etching procedures. For example, the circuit patterns 31 and 33 and lines 34 and 35 may preferably comprise 63 percent by volume of Versalon 1140 (a polyamide adhesive) with 37 percent by volume of Silflake 135 which is then screened on in a conventional manner using an artist's air brush and a template.

The thickness of the coating applied may vary and is conventionally between 5 to 25 microns with 10 to 20 microns being most preferred. For other examples of suitable conductive materials or inks suitable for the patterns 31, 33 and lines 34 and 35 reference may be had to U.S. Patent No. 3,860,771, 3,862,382 and 3,862,381 which disclosure is incorporated herein by reference thereto.

In addition reference may be had to the above patents for a description of other electrically conductive filler particles suitable for use in this invention, e.g., silver coated copper, nickel, gold, silver coated glass, etc.

The thickness of the sheet can obviously be varied over a wide range, e.g., from a few mils to 100 mils or greater. It has been found that a Mylar sheet of a thickness of 4 mil is suitable for the practice of this invention. In addition, it should be understood that the exact configuration of the circuits 31 and 33 as well as the lines 34 and 35 may be varied depending upon the output code desired as will be apparent to those skilled in the art.

Figure 2:
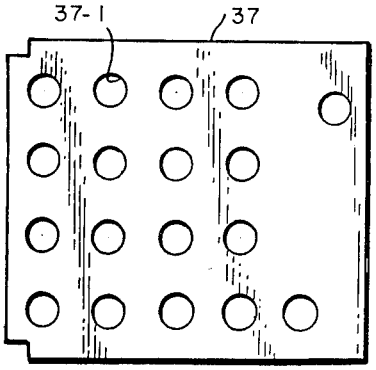
FIG. 2 is a top plan view of a spacer of a keyboard, according to the disclosure.

In FIG. 2 there is disclosed a non-conductive spacer 37 having conventional spacer holes 37-1 of the type as shown in U.S. Pat. No. 3,860,771. The spacer may be polyester, e.g. Mylar, polypropylene, polyethylene, etc., as will be apparent to those skilled in the art.

Figure 4:
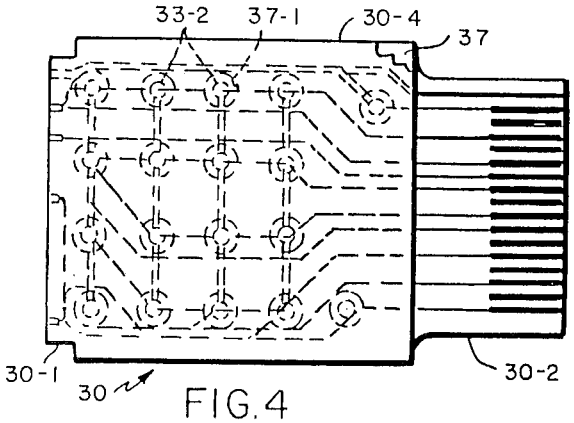
FIG. 4 is a top plan view showing the keyboard of the disclosure.
Figure 3:
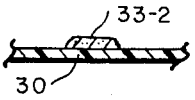
FIG. 3 is a sectional view taken along line 3—3 in FIG. 1.
Figure 5:
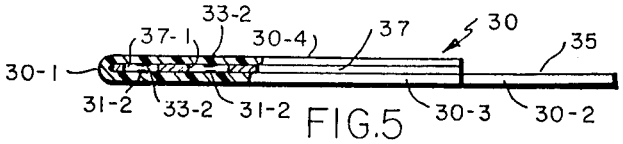
FIG. 5 is a side view of the keyboard device of FIG. 4.
Figure 6:
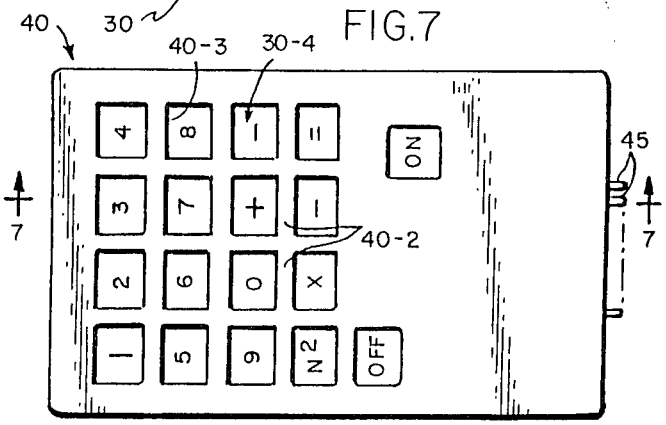
FIG. 6 is a top plan view of the keyboard of FIGS. 4 and 5 in a keyboard frame.

The spacer is positioned as shown in FIGS. 4-6 so that the circuit pattern 31 may be electrically isolated from pattern 33 while at the same time permitting the contactors 33-2 to extend through the holes 37-1 (which are in alignment therewith) when the sheet is depressed by a human finger applied to the sheet to make contact with selective ones of the contacts 31-2 in the manner as shown in U.S. Pat. Nos. 3,860,771, 3,862,382 and 3,862,381.

Figure 7:
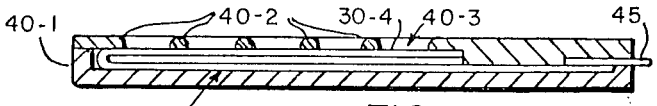
FIG. 7 is a sectional view taken along line 7—7 in FIG. 6.

FIGS. 6 and 7 show the keyboard construction of FIGS. 4 and 5 mounted in a casing or frame comprising sections 40-1 and 40-2 which are coupled together by gluing, heat seals, screws or by other conventional methods.

The frame portion has openings 40-3 under which there is provided the folded component sheet 30 positioned with the underside of the sheet section 30-4 seen through the holes 40-3.

Legend or indicia, e.g. numbers are printed or applied to the sheet section 30-4 as is well known in the prior art.

The contactors 33-2, the holes 37-1 and the contacts 31-2 are aligned under the holes 40-3 so that pressure applied to sheet section 30-4 will cause connection of a contactor 33-2 to contact 31-2.

The output from the keyboard is obtained via pins 45 supported in the frame 40 and which are positioned in contact with connection lines 34A and 35A.

In the device showm in FIGS. 6 and 7 the sheet 30 is held in a folded condition by the frame with the spacer 37 sandwiched between them. It should be understood that adhesive e.g., a pressure sensitive adhesive, NYCAL sold by Northern Engraving Co. of Sparta, Wis. may also be used to maintain the sheet 30 folded.

In addition, conventional heatseals or pins or other means known in the art may be used to maintain the sheet in a folded condition.

Reference should now be had to FIGS. 8-11 which show the sheet of FIGS. 107 having the same circuit patterns and lines provided with raised protrusions as for example, as shown in U.S. Pat. No. 3,860,771 and which may be formed as disclosed in that patent. The sheet is for example of Mylar as shown in U.S. Pat. No. 3,860,771 and has a plurality of protrusions 30-5 formed in contactor supporting sections 30-4. The protrusions preferably snap to provide a tactile feel and include a pedestal 30-5A and a curved surface 30-5B which has adhered thereto the contactor 33-2 and indicia 30-6 applied to the top thereof. The spacer is again shown at 37 (see FIG. 10). FIG. 8A shows alignment means, e.g. a fold depression or channel 30-1A formed in the sheet in the same manner as the protrusions 30-5 to permit the sheet 30, to be easily folded when being assembled to align contacts and contactors as shown.

Figure 8:
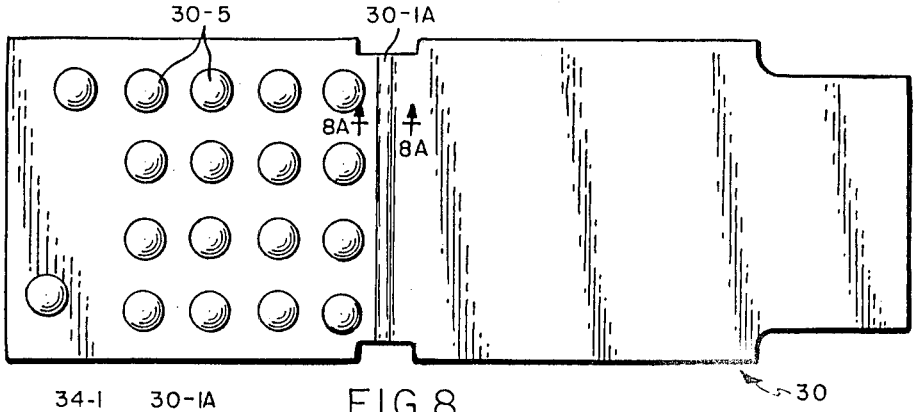
FIG. 8 is a top plan view of the component of FIG. 1 provided with protrusions to provide a tactile feel to the user when depressed.
Figure 8A:
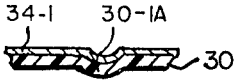
FIG. 8A is a sectional view taken along line 8A—8A in FIG. 8.
Figure 10:
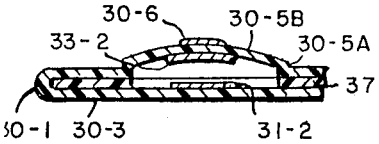
FIG. 10 is a sectional view taken along line 10—10 in FIG. 9.
Figure 9:
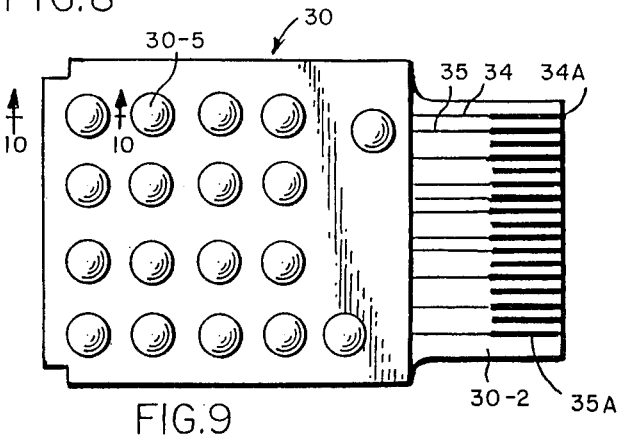
FIG. 9 shows in a top plan view the keyboard using the component of claim 8 and the same contact and contactor circuit pattern shown in FIG. 1.
Figure 11:
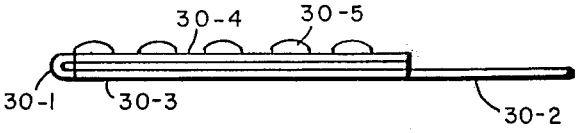
FIG. 11 is a side view of the assembled keyboard structure of FIG. 9.

FIGS. 9, 10 and 11 in particular show the keyboard formed from the sheet of FIG. 8 with the depressible protrusions shown at 30-5. Upon depression of the protrusions 30-5 contact may be made between contactors 33-2 and contacts 31-2.

The keyboard may be held together in a folded condition by the frame by adhesive or by other conventional means.

Figure 12:
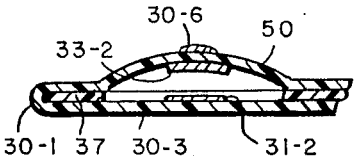
FIG. 12 illustrates a modification of the protrusions shown in FIG. 10.

In FIG. 12 there is shown a variation of the protrusions of FIGS. 8–11. In this Figure the protrusion comprises a curved surface (convex) 50 without pedestal with the remaining parts being the same as in FIGS. 1–11.

Figure 13:
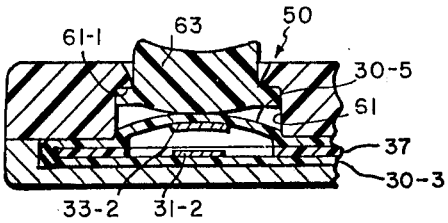
FIG. 13 is a view showing keyboard assembly using supplemental buttons with the keyboard of FIGS. 9 to 11.

In FIG. 13 there is shown the keyboard construction of FIGS. 8 to 11 positioned in a two piece frame 60 and having a cutout 61 with shoulders 61-1 in which there is positioned a button 63 for depressing the protrusion 30-5 to close contactor 33-2 upon contact 31-2. See FIG. 19 of U.S. Pat. No. 3,860,771 for additional detail.

Figure 14:
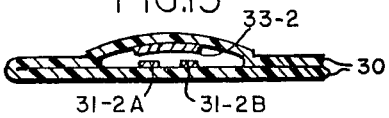
FIG. 14 illustrates a modification of the keyboard structure shown in FIG. 10.

FIG. 14 shows the keyboard of FIGS. 8-11 without the contact 31-2 being segmented into sections 31-2A and 31-2B and contactors and contactor 33-2 isolated and not tied into lines 34 so that the output is dependent upon the electrical bridging of contacts 31-2A and 31-2B.

It should be understood that with this construction the contactors may be raised sufficiently that a spacer 37 is no longer needed. It should also be understood that adhesive applied to hold the folded sheet in a folded condition can also serve as the spacer 37 is desired.

Figure 15:
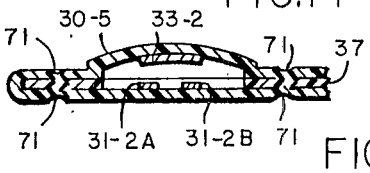
FIG. 15 illustrates yet another modification of the keyboard structure shown in FIG. 10.

FIG. 15 shows in a similar view to FIG. 14 a heat sealed keyboard having heat seals at 71. In this view a spacer 37 is provided.

Figure 17:
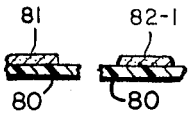
FIG. 17 is a sectional view taken along line 17—17 in FIG. 16.
Figure 16:
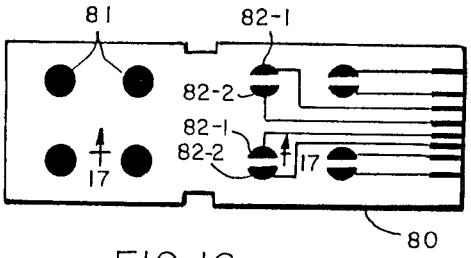
FIG. 16 illustrates a modified contactor pattern for use in electrically connecting together contact segments in the manner as shown in FIG. 14.

FIGS. 16 and 17 show a modified keyboard sheet 80 having spaced apart contactors at 81 and multiple contact segments at 82-1 and 82-2. This construction may be folded over as shown in FIG. 14 to form a keyboard of the flat type or be provided with protrusions as shown in FIG. 14.

Figure 18:
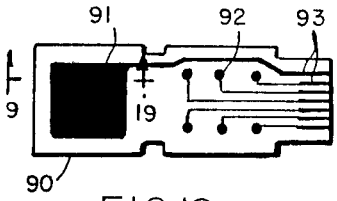
FIG. 18 illustrates a further modified contactor structure and contaact pattern.
Figure 19:
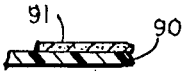
FIG. 19 is a sectional view taken along line 19—19 in FIG. 18.

FIGS. 18 and 19 show yet another modified keyboard sheet 90 and which includes a layer of conductive material 91 as in U.S. Pat. No. 3,862,381 which is used as the contactor. In this configuration a spacer as shown at 37, FIG. 2, is placed between the contacts 92 and contactor 91. Connection lines are provided at 93.

Figure 20:
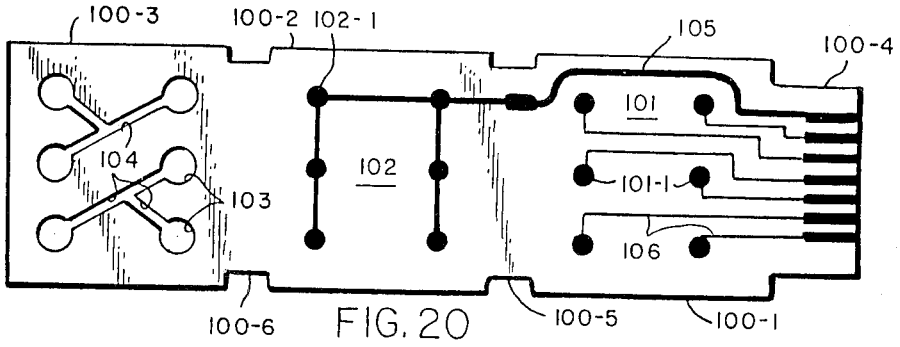
FIG. 20 illustrates in a top view a keyboard component which includes in a single unit a spacer section contactor support section and contact support section.
Figure 21:
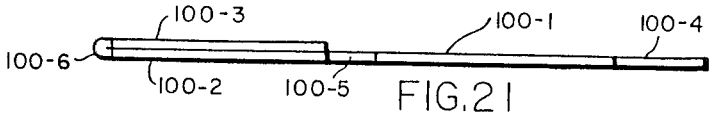
FIG. 21 shows in a side view the spacer section folded over the contactor section.
Figure 22:
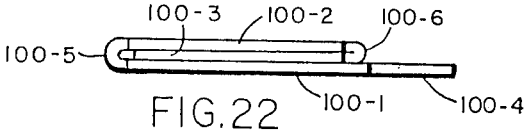
FIG. 22 shows in a side view a keyboard sandwich with the spacer section sandwiched between the contact and contactor sections.

Reference should now be had to FIGS. 20 to 22 which disclose a multiple section keyboard component construction. The sheet includes as shown at 100-1 a bottom section for supporting a circuit pattern 101 having contacts 101-1. The sheet also includes a center section 100-2 for supporting a second circuit pattern 102 having contactors 102-1 and a spacer section having holes 103 which are shown interconnected by gas passage channels of the type for preventing a spongy feeling to the user because of trapped gas when the sheet is sealed together as shown in FIG. 22 to form a keyboard.

The sheet also includes fold sections 100-5 and 100-6 as well as tail interconnecting section 100-4. Interconnecting lines are provided at 105 for circuit pattern 102 and at 106 for circuit pattern 101.

The patterns 101 and 102 as well as lines 105 and 106 are preferably screened on in a conventional manner using electrically conductive flexible plastic inks.

FIG. 21 shows the spacer section 100-3 folded over the section 100-2 and FIG. 22 shows the spacer section 100-3 sandwiched between sections 100-3 and 100-1 with the holes 103 thereof positioned to permit the contactors 102-1 to be forced therethrough to make electrical contact with contactors 101-1.

The keyboard may be sealed together using glue to provide an air tight unit. The channels 104 in the spacer permit the travel of trapped gas between holes 103 when one contactor is depressed thus preventing the user from experiencing a feeling that trapped gas is being compressed. In addition, atmospheric relief holes may also be included which extend through the bottom 100-1 and into the passages 104 in the event the keyboard is to be used under high altitude conditions.

Figure 23:
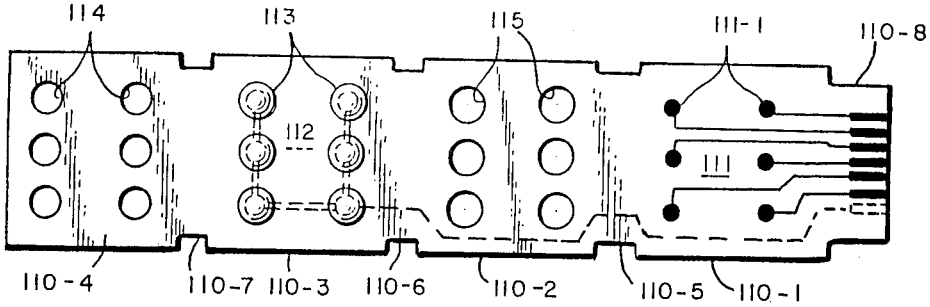
FIG. 23 illustrates in a top view a multiple section keyboard component having a spacer section, contactor section, contact section and a section through which buttons may extend.
Figure 24:
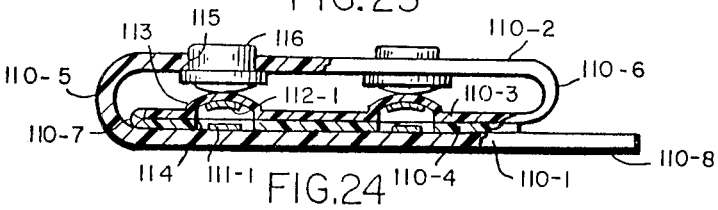
FIG. 24 illustrates in a partial sectional side view the keyboard component of FIG. 23 folded as a keyboard.

In FIGS. 23 and 24 there is shown a keyboard component and a keyboard formed therefrom which includes a sheet section for retaining buttons.

In this configuration, the sheet comprises a bottom section 110-1, a top section 110-2, middle sections 110-3, 110-4, 110-5, 110-6 and 110-7 as well as tail section 110-8.

Sections 110-2 and 110-1 may be made thicker as shown to provide extra sturdiness if desired for the device, e.g., 30 mils thick whereas the sections 110-3 and 110-4 may remain relatively thin, e.g., 5 mils thick.

It should also be understood that the thickness of the entire sheet may be increased, for example, to 30 mils or greater if desired.

Section 100-1 supports a circuit pattern 111 having contacts 111-1 on the top surface thereof whereas section 110-3 supports a circuit pattern 112 having contactors 112-1 on the underside thereof (shown dotted). In addition section 110-3 is also provided with snap protrusions 113 of the type shown in FIGS. 8 – 11. Spacer section 110-4 is provided with the conventional spacer holes -14 whereas section 110-2 is provided with button positioning holes 115. FIG. 24 shows the unit folded as a keyboard with buttons 116 positioned in holes 115 in place to depress protrusion 113 to cause contactor 112-1 to touch contact 111-1 through spacer hole 114.

Connection lines for circuit pattern 111 are shown at 117 and connection line is shown at 118 (shown dotted) for circuit pattern 112. The keyboard may be glued together to retain it folded as shown or may be placed in a frame to accomplish same.

Figure 25:
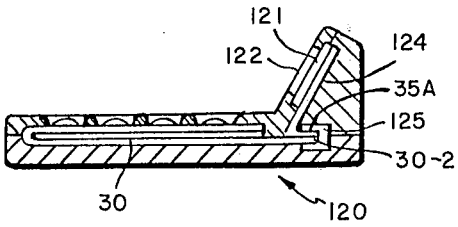
FIG. 25 illustrates in a partial sectional view the keyboard of FIGS. 9–11 in a calculator frame.

FIG. 25 illustrates the keyboard of FIGS. 8–11 positioned in a calculator frame 120. In this calculator is typically shown the integrated circuit chip driver and logic element at 121 conventionally coupled to display 122 both supported by a non-conductive bracket 123 having multiple conductive lines 124 for connection to lines 34A and 35A positioned on the tail section of the keyboard (see FIG. 9).

Coupling is simply made by use of a spring clip 125, e.g., of plastic to hold tail section 30-2 thereby joining connection lines of 124 and 30 to each other in a predetermined manner.

Figure 26:
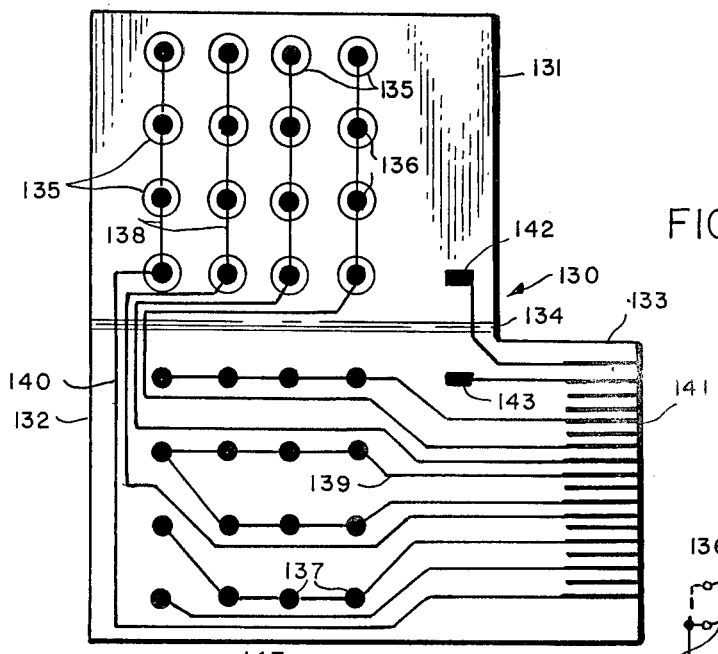
FIG. 26 illustrates in a bottom view the "L" shaped foldover sheet or blank for the keyboard of this disclosure.
Figure 27:
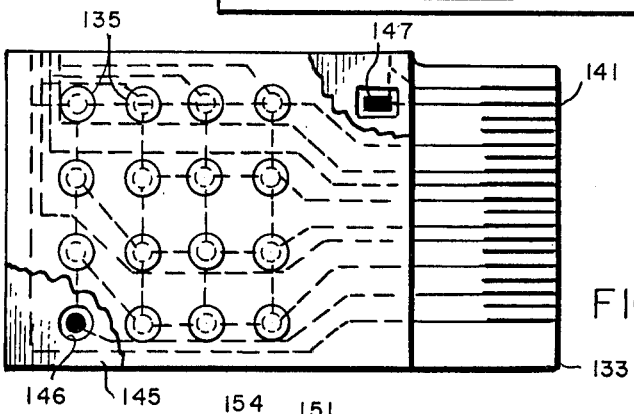
FIG. 27 illustrates the sheet of FIG. 26 folded over upon itself to provide a keyboard.

Reference should now be had to FIGS. 26 and 27 which illustrate the "L" shaped flexible and resilient plastic sheet 130 (e.g., Mylar) in a side foldover configuration. The advantage of this type of sheet construction over that shown in FIGS. 1 to 25 is in the case where it is desired to reduce the resistance of the on-off or other switch which is normally held closed during the operation of, for example, a calculator.

With this side foldover configuration, it is possible to reduce the circuit line lengths to the contacts of the on-off switch extending from the terminals for external connection which are positioned on the tail in contrast with what would be required if an on-off switch were incorporated in the device shown in FIG. 1 (See length of line 34).

Figure 28:
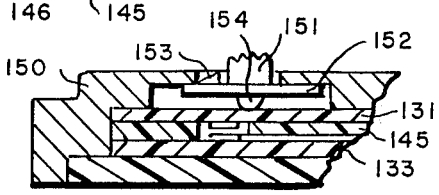
FIGS. 28 and 29 illustrate a switch for operating the on-off switch contacts supported by the sheet of the keyboard.
Figure 29:
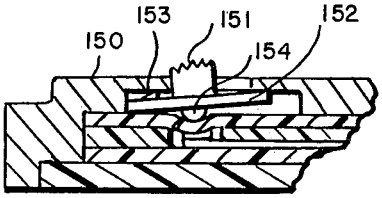
Figure 31:
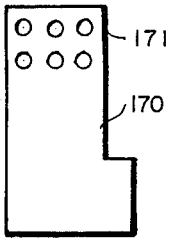
FIGS. 31 to 34 illustrate diagrammatically the positions for incorporation of a spacer of the type shown in FIG. 20 or 23 as part of the "L" shaped sheet of FIG. 26.
Figure 32:
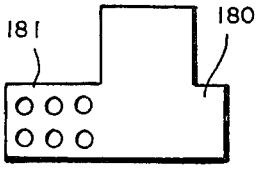
Figure 33:
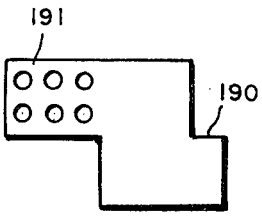
Figure 34:
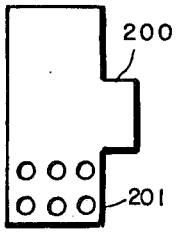

In particular the sheet comprises an "L" shaped or substantially right angled blank having a first section 131 for supporting contactors 136 in snappable protrusions 135 of the type set forth in FIGS. 1–7 and described with reference thereto, a second section 132 for supporting contacts 137 for alignment with respect to contacts 136 and a tail section 133 having terminals 141 with circuit pattern lead lines 138, 139 and 140 extending therefrom. At 142 and 143 there is shown the contactor and contact of a typical on-off switch which are also coupled to terminals 141. The contactors, contacts, terminals, and circuit patterns all preferably comprise electrically conductive plastic screened on the surface of the sheet. Between sections 131 and 134 an alignment means, e.g., an alignment channel, is preferably provided to properly line the contactors over the contacts when section 131 is folded over section 132. In FIG. 27 a spacer 145 is shown having openings 146 in alignment with the contacts and contactors so that a contactor may be forced into the opening to touch the contact therebelow. FIGS. 28 and 29 illustrate a typical actuator for the on-off contactor and contact 142 and 143. The actuator shown is of the type that is disclosed in U.S. Pat. No. 3,806,685 and comprises a pusher projection 151 and a support 152 for a button 154 for causing contactor 142 to engage contact 143. The support includes an inclined raised projection 153 for engaging a portion of the calculator frame 150 for the keyboard 130. Upon the pushing of the actuator 151 to the left of FIG. 29, the button 154 causes contactor 142 to engage contact 142 through the spacer opening 147 and remain in contact therewith until moved again to the position shown in FIG. 28.

Figure 30:
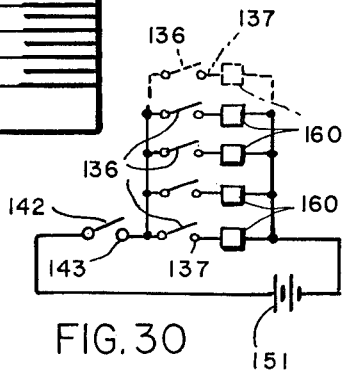
FIG. 30 illustrates the circuit comprising the on-off switch in a typical keyboard circuit.

FIG. 30 schematically discloses a typical calculator circuit with the contactor 142 and contact 143 in series with the parallel key contactors 136 and contacts 137 which are in turn in series with the loads 160 (logic) which they control. A battery source is shown at 161 for providing power to the device.

Thus the reduction in resistance in the on-off switch provides significant advantages if it is desired to reduce the resistance in series with each contact and contactor of the keys and the associated load.

Reference should be had to FIGS. 31–34 which disclose typical "L" shaped keyboard configurations 170, 180, 190, and 200 having a spacer 171, 181, 191, and 201 respectively coupled thereto and forming part of the sheet. These figures illustrate the various positions in which a spacer having hole, e.g. as in FIG. 20, may be formed as part of the sheet and be folded over to provide the center of the sandwich comprising the first and second sections 131 and 132 and the tail section shown in FIG. 26.

Thus as may be seen there has been provided a new and improved as well as inexpensive keyboard construction which permits substantial cost reduction by using one part to provide a multiplicity of functions. While only preferred embodiments of the device have been shown it is intended that this invention be interpreted as contemplating any variations which would be apparent to those of ordinary skill in the art.

We claim:

1. A keyboard component for a keyboard comprising a unitary sheet of flexible and resilient insulator plastic having first and second sections supporting contactors and contacts respectively and a tail section supporting terminals, said first section having protrusions supporting at least some of said contactors, said sections being disposed to one another in an L configuration with said first section forming one leg of said "L" and said tail section and said second section forming the other leg of said "L," said first section being foldable over said second section to align said contactors with said contacts, a contactor of an on-off switch supported by said first section, a contact of an on-off switch supported by said second section, said contactor and contact spaced substantially equidistant from the intersection of the legs of the L, a first circuit line supported by said first, second and tail sections, and extending across said intersection of the legs of the L, a second circuit line adjacent said first circuit line and supported by said second and tail sections, said first circuit line coupled to said contactor and said second circuit line coupled to said contact, and terminals supported by said tail, one terminal coupled to each circuit line and actuator means movable between on and off positions to cause said contactor to engage said contact when said actuator is in said on position.

2. The keyboard component of claim 1 in which said sheet includes a spacer as a part thereof having a plurality of openings therethrough for selective alignment with said contacts and contactors when folded between said first and second sections.

3. The keyboard component of claim 1 in which alignment means is positioned in said sheet between said first and second sections.

4. The keyboard component of claim 1, said sheet having a plurality of snapable protrusions supporting at least some of said contactors.

5. A keyboard comprising the component of claim 1 with the first section folded over said second section to align said contactors with said contacts and a spacer positioned between said first and second sections and having a plurality of openings, one opening in register with each aligned contactorcontact pair.

6. A keyboard comprising a unitary sheet of flexible and resilient insulator plastic having first and second sections for supporting at least some of contactors and contacts, said sections being relatively foldable with respect to each other, said sheet haing a foldable button retaining section having a plurality of openings, and buttons retained in said openings and movable to selectively urge said contactors against said contacts.

7. The keyboard of claim 6 wherein one of said sections has a plurality of snappable protrusions supporting said contactors, said protrusions in engagement with said buttons, and a spacer positioned between said first and second sections and having a plurality of openings, a different opening in register with a different one of said protrusions.

8. The keyboard of claim 7 in which said sheet includes a spacer section foldable between said first and second sections and having a plurality of openings in selective register with said contacts and contactors.

9. A keyboard component for a keyboard comprising a unitary sheet of flexible and resilient plastic having first and second sections, said first section supporting contractors and said second section supporting contacts on the same surface of the sheet and a preformed fold depression alignment means in said sheet between said first and second sections to align said contactors and contacts to one another when said sections are folded about said depression.

10. The component of claim 9 in which said depression is concave with respect to said sheet surface supporting said contactors and contacts.

11. The component of claim 10 in which said sheet has snappable protrusions formed therein which support said contactors.

12. The component of claim 9 in which said sheet has snappable protrusions formed therein which support said contactors.

13. The component of claim 9 in which at least one circuit line is supported by said sheet and extends across said depression between said sections and has the contour of said depression.

14. A keyboard comprising a unitary sheet of flexible and resilient plastic having first and second sections, said first section supporting contactors and said second section supporting contacts on the same surface of the sheet, a preformed fold depression alignment means in said sheet between said first and second sections to align said contactors and contacts to one another when said sections are folded about said depression, a spacer having a plurality of openings in selective alignment with said contactors and contacts and positioned at the center of a sandwich with the first and second sections folded about said spacer, said spacer extending into said depression and against the surface thereof to selectively align said openings with respect to said contactors and contacts, and means for retaining said sheet in a folded condition with said spacer between said first and second sections.

15. The keyboard of claim 14 in which said spacer is part of said sheet.

16. The keyboard of claim 14 in which said sheet includes snapable protrusions formed therein.

17. The keyboard of claim 16 in which the depression is concave with respect to the surface of said sheet supporting said contactors and contacts.

* * * * *